US011213440B2

(12) United States Patent
Sekizuka et al.

(10) Patent No.: US 11,213,440 B2
(45) Date of Patent: Jan. 4, 2022

(54) WHEELCHAIR FIXING TOOL AND WHEELCHAIR FIXING DEVICE

(71) Applicant: Toyota Jidosha Kabushiki Kaisha, Toyota (JP)

(72) Inventors: Makoto Sekizuka, Toyota (JP); Osamu Fukawatase, Miyoshi (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/830,978

(22) Filed: Mar. 26, 2020

(65) Prior Publication Data

US 2020/0390623 A1 Dec. 17, 2020

(30) Foreign Application Priority Data

Jun. 11, 2019 (JP) ..... JP2019-108776

(51) Int. Cl.
*A61G 3/08* (2006.01)

(52) U.S. Cl.
CPC ..... *A61G 3/0808* (2013.01)

(58) Field of Classification Search
CPC ..... A61G 3/0808; A61G 2203/14; A61G 2203/80; A61G 3/062; A61G 5/045; A61G 1/0212; A61G 1/0237; A61G 1/0275
USPC .... 410/3, 7, 23, 19, 30, 97, 120, 2, 100, 11, 410/96, 9, 8, 67; 414/480, 462, 477, 484, 414/563, 788.3, 537, 227
See application file for complete search history.

(56) References Cited

U.S. PATENT DOCUMENTS

| | | | | |
|---|---|---|---|---|
| 4,886,403 | A * | 12/1989 | Gresham | B60P 3/075 410/10 |
| 4,995,775 | A * | 2/1991 | Gresham | A61G 3/0808 410/10 |
| 6,406,230 | B1 * | 6/2002 | Mason | B60P 7/083 410/100 |
| 7,758,095 | B2 * | 7/2010 | Elhanany | B60N 2/4242 296/63 |
| 9,616,843 | B2 * | 4/2017 | Girardin | B60N 2/304 |
| 2005/0214088 | A1 * | 9/2005 | Acton | A61G 3/0808 410/3 |
| 2014/0356090 | A1 * | 12/2014 | Cardona | A61G 3/0808 410/3 |
| 2015/0104281 | A1 * | 4/2015 | Day, Jr. | A61G 3/061 414/537 |
| 2018/0338875 | A1 * | 11/2018 | Cardona | B66D 3/006 |

FOREIGN PATENT DOCUMENTS

| | | | |
|---|---|---|---|
| JP | H08089532 | A | 4/1996 |
| JP | 2001-212179 | A | 8/2001 |
| JP | 2002-360636 | A | 12/2002 |
| JP | 2007-222278 | A | 9/2007 |
| JP | 2018-089525 | A | 6/2018 |

* cited by examiner

*Primary Examiner* — D Glenn Dayoan
*Assistant Examiner* — Sunsurraye Westbrook
(74) *Attorney, Agent, or Firm* — Dinsmore & Shohl LLP

(57) ABSTRACT

A wheelchair fixing tool includes: a fixing part fixed to an upright member uprightly provided in a vehicle cabin; a hook detachable from a wheelchair: and a belt member formed long, having stretchability, and connecting the fixing part and the hook.

10 Claims, 7 Drawing Sheets

WHEELCHAIR FIXING TOOL AND WHEELCHAIR FIXING DEVICE

CROSS-REFERENCE TO RELATED APPLICATIONS

This application claims priority to Japanese Patent Application No. 2019-108776 filed on Jun. 11, 2019, which is incorporated herein by reference in its entirety including the specification, drawings and abstract.

BACKGROUND

1. Technical Field

The present disclosure relates to a wheelchair fixing tool and a wheelchair fixing device.

2. Description of Related Art

Japanese Patent Application Publication No. 8-089532 (JP 8-089532 A) discloses a fixing device for securing (fixing) a wheelchair in a vehicle cabin by a pair of belt-type restraining means. The pair of belt-type restraining means each includes a retractor, a buckle, and a tongue plate. The tongue plate included in the belt-type restraining means on the other side is engaged with the buckle included in the belt-type restraining means on one side. Similarly, the tongue plate included in the belt-type restraining means on one side is engaged with the buckle included in the belt-type restraining means on the other side, and the wheelchair is secured by these buckles and these tongue plates. The securing state of the wheelchair is released by releasing the engagement between the buckles and the tongue plates.

SUMMARY

In the structure described in JP 8-089532 A, the wheelchair can be secured and released from the securing state by hands of an occupant sitting in the wheelchair. However, since the fixing device is configured by a main belt having the buckles and a sub-belt having the tongue plates, the structure becomes complicated.

In light of the above circumstances, the present disclosure provides a wheelchair fixing tool and a wheelchair fixing device having a simple structure and capable of securing and releasing securing of a wheelchair with hands of an occupant seated in the wheelchair.

A wheelchair fixing tool of a first aspect of the present disclosure: a fixing part fixed to an upright member uprightly provided in a vehicle cabin; a hook detachable from a wheelchair: and a belt member formed long, having stretchability, and connecting the fixing part and the hook.

In the wheelchair fixing tool of the first aspect, the fixing part is fixed to the upright member provided in the vehicle cabin. The hook detachable from the wheelchair and the fixing part are connected by the belt member formed in a long shape. Thereby, the occupant sitting in the wheelchair can secure the wheelchair by mounting the hook to the wheelchair. Since the belt member has stretchability, the occupant sitting in the wheelchair can pull the hook against the tension of the belt member from a state in which the hook is mounted to the wheelchair, to thereby detach the hook from the wheelchair.

Since the structure that the fixing part and the hook are connected by the belt member having stretchability is employed, the wheelchair can be secured with a simpler structure as compared with a structure including a plurality of belts. Note that the term "stretchability" as used herein refers to a stretchable property that allows the hook to be detached from the wheelchair by human power.

In the wheelchair fixing tool of a second aspect of the present disclosure according to the first aspect, at least a part of the belt member is formed by a rubber string.

In the wheelchair fixing tool of the second aspect, the belt member can be provided with stretchability by a rubber string. In addition, the production cost can be reduced by using a rubber string that is easily available.

In the wheelchair fixing tool of a third aspect of the present disclosure according to the first or second aspect, the belt member is provided with a stretch restricting member restricting the belt member from being stretched to a predetermined length or longer.

In the wheelchair fixing tool of the third aspect, even in the case in which an excessive inertial force is applied to the wheelchair when a heavy load is input into the vehicle (e.g., at the time of sudden braking during traveling or a collision), the belt member can be restricted from being stretched to the predetermined length or longer by the stretch restricting member.

In the wheelchair fixing tool of a fourth aspect of the present disclosure according to the third aspect, the stretch restricting member is a metallic wire member extending along the belt member and connecting the fixing part and the hook, the wire member is formed to be longer than the belt member in a state in which the hook is mounted to the wheelchair and be shorter than a length at which the belt member becomes broken and disconnected.

In the wheelchair fixing tool of the fourth aspect, since the metallic wire member is longer than the belt member when the hook is mounted to the wheelchair, it is possible to prevent the wire member from being tensed when the hook is mounted to the wheelchair. Further, since the wire member is shorter than the length of the belt member at which the belt member becomes broken and disconnected, the breakage and disconnection of the belt member can be prevented even when the belt member is stretched due to an inertial force acting on the wheelchair, or the like. Further, since the wire member is provided to extend along the belt member, it is possible to restrain the wire member from being caught by a peripheral object or person.

In the wheelchair fixing tool of a fifth aspect of the present disclosure according to the first aspect, at least a part of the belt member is formed by a tension spring.

In the wheelchair fixing tool of the fifth aspect, at least a part of the belt member is formed by a tension spring. Thereby, when the belt member is stretched and the tension spring is fully tensed, the belt member can be restricted from being further stretched. That is, it is possible to restrict the belt member from being stretched to the predetermined length or longer without separately providing a stretch restricting member.

A wheelchair fixing tool of a sixth aspect of the present disclosure includes: a belt member formed long; a retractor fixed to an upright member uprightly provided in a vehicle cabin, one end of the belt member being wound around the retractor, the retractor restricting pull-out of the belt member according to an amount of wind-up of the belt member; a hook detachable from the wheelchair; and a connecting member that is provided to the other end of the belt member, connects the belt member and the hook, and is able to release connection between the belt member and the hook by handling of an occupant seated in the wheelchair.

In the wheelchair fixing tool of the sixth aspect, the wheelchair fixing tool has a retractor fixed to the upright member provided in the vehicle cabin, and one end of the long belt member is wound around the retractor. The retractor restricts the belt member from being pulled out in accordance with the amount of wind-up of the belt member. The hook is connected to the other end of the belt member via the connecting member. With this configuration, the occupant seated in the wheelchair can easily secure the wheelchair by pulling out the belt member and mounting the hook to the wheelchair. The connecting member is configured to be able to release the connecting state between the belt member and the hook by handling of the occupant. Therefore, the occupant seated in the wheelchair can release the securing state of the wheelchair only by handling the connecting member from the state in which the hook is mounted to the wheelchair.

Because of the structure in which the belt member and the hook are connected by the connecting member, the wheelchair can be secured with a simpler structure as compared with a structure including a plurality of belts.

A wheelchair fixing device of a seventh aspect of the present disclosure includes: the wheelchair fixing tool as set forth in any of the first to sixth aspects; and a hooking part provided to the upright member and configured to hold the hook in a state of being hooked on the hooking part.

In the wheelchair fixing device of the seventh aspect, the hook can be hooked on the hooking part while the wheelchair is not secured and out of use. Further, when the wheelchair is secured, the hook can be used simply by detaching the hook from the hooking part.

In the wheelchair fixing device of an eighth aspect of the present disclosure according to the seventh, the hooking part is provided at a position where tension acts on the belt member in a state in which the hook is hooked.

In the wheelchair fixing device of the eighth aspect, the hook is hooked on the hooking part in a state where tension is applied to the belt member. Accordingly, it is possible to prevent the hook from coming off from the hooking part due to vibration or the like during traveling of the vehicle.

As aforementioned, according to the wheelchair fixing tool of the first aspect, the wheelchair can be secured and released from the securing state by the hands of the occupant sitting in the wheelchair, and the structure can be simplified.

According to the wheelchair fixing tool of the second aspect, the belt member can be provided with stretchability with an inexpensive and simple structure.

According to the wheelchair fixing tool of the third aspect, the wheelchair fixing tool can be applied to a vehicle traveling at a high speed.

According to the wheelchair fixing tool of the fourth aspect, the wheelchair fixing tool can be applied to a vehicle traveling at a high speed, and when the hook is mounted to the wheelchair, the wire member does not interfere with the mounting.

According to the wheelchair fixing tool of the fifth aspect, it is possible to restrict the belt member from being stretched to the predetermined length or longer with a simple structure.

According to the wheelchair fixing tool of the sixth aspect, the wheelchair can be secured and released from the securing by the hands of the occupant sitting in the wheelchair, and the structure can be simpler as compared with a structure having a plurality of belts.

According to the wheelchair fixing device of the seventh aspect, the securing work can be more easily performed as compared with the configuration in which a hook out of use is placed on a floor in a vehicle cabin.

According to the wheelchair fixing device of the eighth aspect, the state in which the hook is hooked on the hooking part can be favorably maintained.

BRIEF DESCRIPTION OF THE DRAWINGS

Features, advantages, and technical and industrial significance of exemplary embodiments of the present disclosure will be described below with reference to the accompanying drawings, in which like numerals denote like elements, and wherein.

DETAILED DESCRIPTION OF EMBODIMENTS

Hereinafter, a wheelchair fixing device including a wheelchair fixing tool 10 according to the first embodiment will be described with reference to the drawings. Arrows UP and FR in each drawing respectively indicate the vehicle upper side and the vehicle front side of a vehicle to which the wheelchair fixing device is applied. Unless otherwise specified, in the description using respective front and rear, left and right, and up and down directions, these directions indicate front and rear in the vehicle front and rear direction, left and right in the vehicle width direction, and up and down in the vehicle height direction, respectively.

Figure 1:
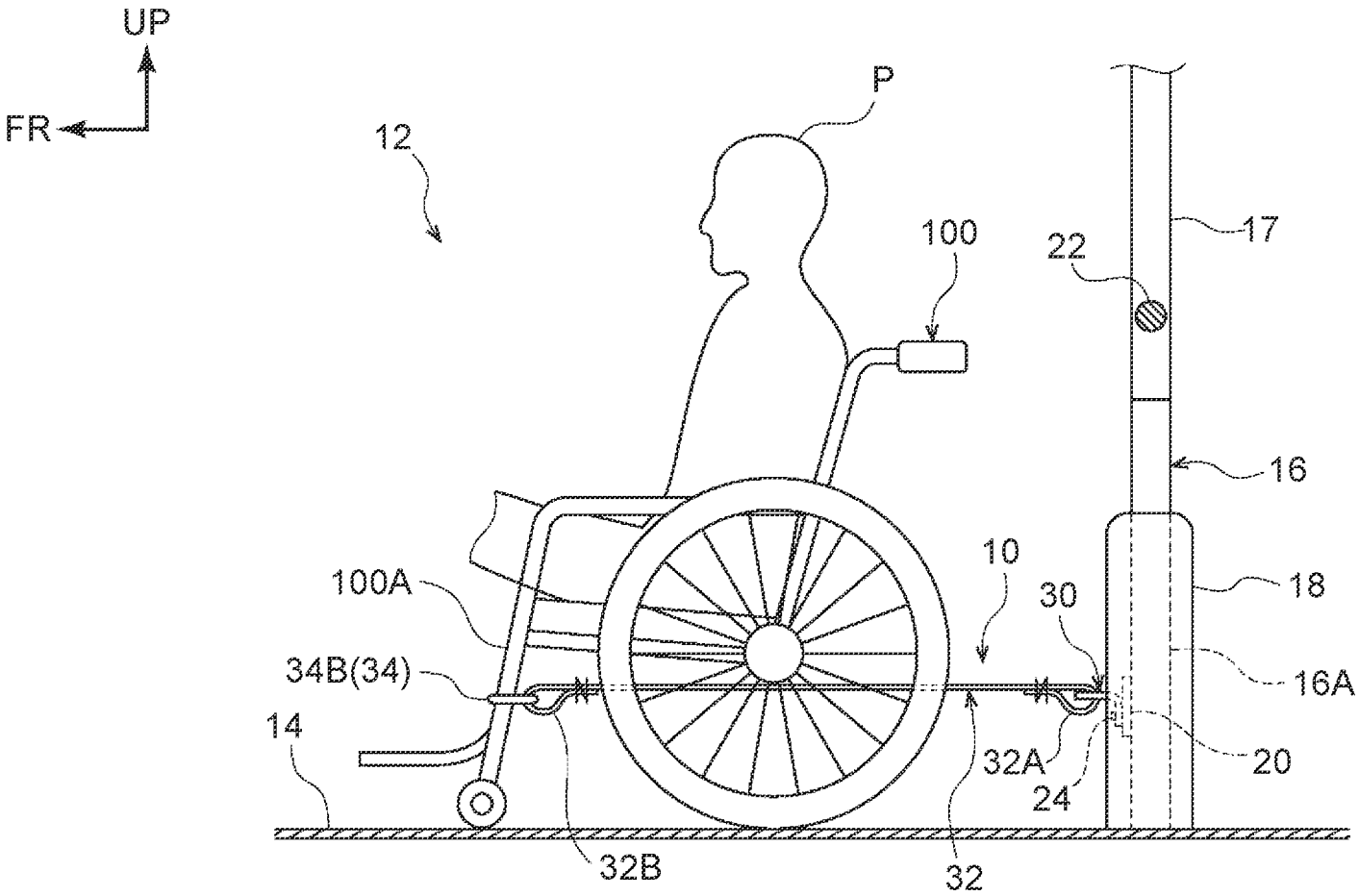
FIG. 1 is a side view of a vehicle cabin of a vehicle to which a wheelchair fixing device according to a first embodiment is applied, as viewed from the vehicle width direction, showing a state in which the wheelchair fixing tool is used.

As shown in FIG. 1, a vehicle 12 to which the wheelchair fixing device of the present embodiment is applied is a vehicle, such as a bus on which a large number of occupants are board, as an example, and the vehicle has a door opening (not shown) through which one hundred wheelchairs 100 can enter. Further, a space used for securing (fixing) the wheelchairs 100 is provided in a vehicle cabin of the vehicle 12, and an upright wall 16 as an upright member is provided in this space.

The upright wall 16 is uprightly provided on a floor panel 14 in such a manner as to extend in the vehicle height direction and the vehicle width direction. In addition, a handrail 17 as an upright member is provided to extend from an upper end of the upright wall 16 in the vehicle upward direction. A pair of handrails 17 are provided with a distance therebetween in the vehicle width direction, and extend to a ceiling of the vehicle 12. Here, a hook holder 22 as a hooking part is provided to a lower part of each handrail 17. The hook holder 22 is formed in a substantially columnar shape, extends from the handrail 17 in the vehicle width direction, and connects a side wall of the vehicle 12 and the handrail 17. Although not shown, the same hook holder is provided to the other handrail.

A lower part 16A of the upright wall 16 is covered with a cover (an interior trim) 18. A mounting bracket 20 is provided to a lower part of the upright wall 16. The mounting bracket 20 is joined to an outer side surface of the upright wall 16, and a plate 30 as a fixing part included in the wheelchair fixing tool 10 is fixed to the mounting bracket 20.

Figure 3A:
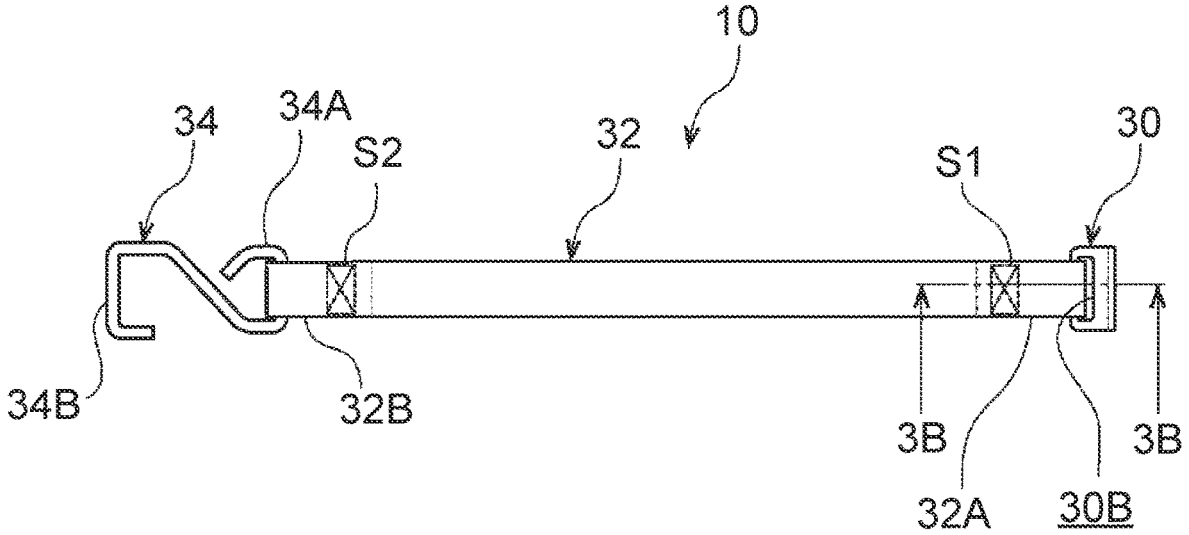
FIG. 3A is an overall view of the wheelchair fixing tool according to the first embodiment.

As shown in FIG. 3A, the wheelchair fixing tool 10 mainly includes the plate 30, a belt member 32, and a hook 34. In the present embodiment, the wheelchair 100 is secured by using a pair of wheelchair fixing tools 10.

Figure 3B:
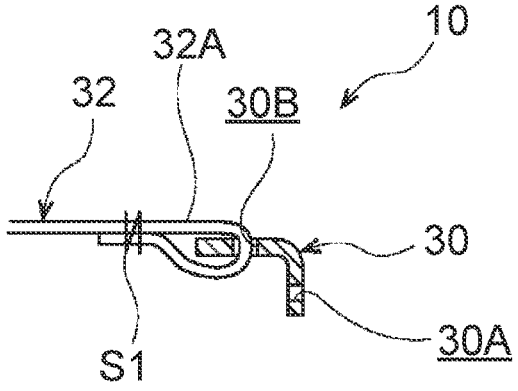
FIG. 3B is a view showing the wheelchair fixing tool according to the first embodiment, and is an enlarged view showing a state taken along line 3B-3B in FIG. 3A.

As shown in FIG. 3B, the plate 30 is made of metal and has a substantially L-shaped cross section, and one surface of the plate 30 is formed with a bolt insertion hole 30A. As shown in FIG. 1, a bolt 24 is inserted into the bolt insertion hole 30A in a state in which the one surface of the plate 30 is laid on the mounting bracket 20, and the bolt 24 is screwed into the mounting bracket 20, to thereby fasten the plate 30 to the mounting bracket 20.

As shown in FIG. 3B, the other surface of the plate 30 is formed with a belt insertion hole 30B. The belt insertion hole 30B is formed slightly wider than the width of the belt member 32 described later, and one end 32A of the belt member 32 is inserted through the belt insertion hole 30B.

As shown in FIG. 3A, the belt member 32 is formed in a long shape, and in the present embodiment, as an example, the entire belt member 32 is formed of a flat rubber string having stretchability.

The one end 32A of the belt member 32 is inserted through the belt insertion hole 30B formed in the plate 30 as described above, and is folded back and stitched at a stitched portion S1 (see FIG. 3B). The other end 32B of the belt member 32 is folded back and stitched at a stitched portion S2 in the same manner as the one end 32A.

The hook 34 is attached to the other end 32B of the belt member 32. In other words, the plate 30 and the hook 34 are connected by the belt member 32. The hook 34 is made of metal and is formed in a substantially S-shape; and one end 34A of the hook 34 is inserted through a loop formed by folding back the other end 32B of the belt member 32.

Figure 2:
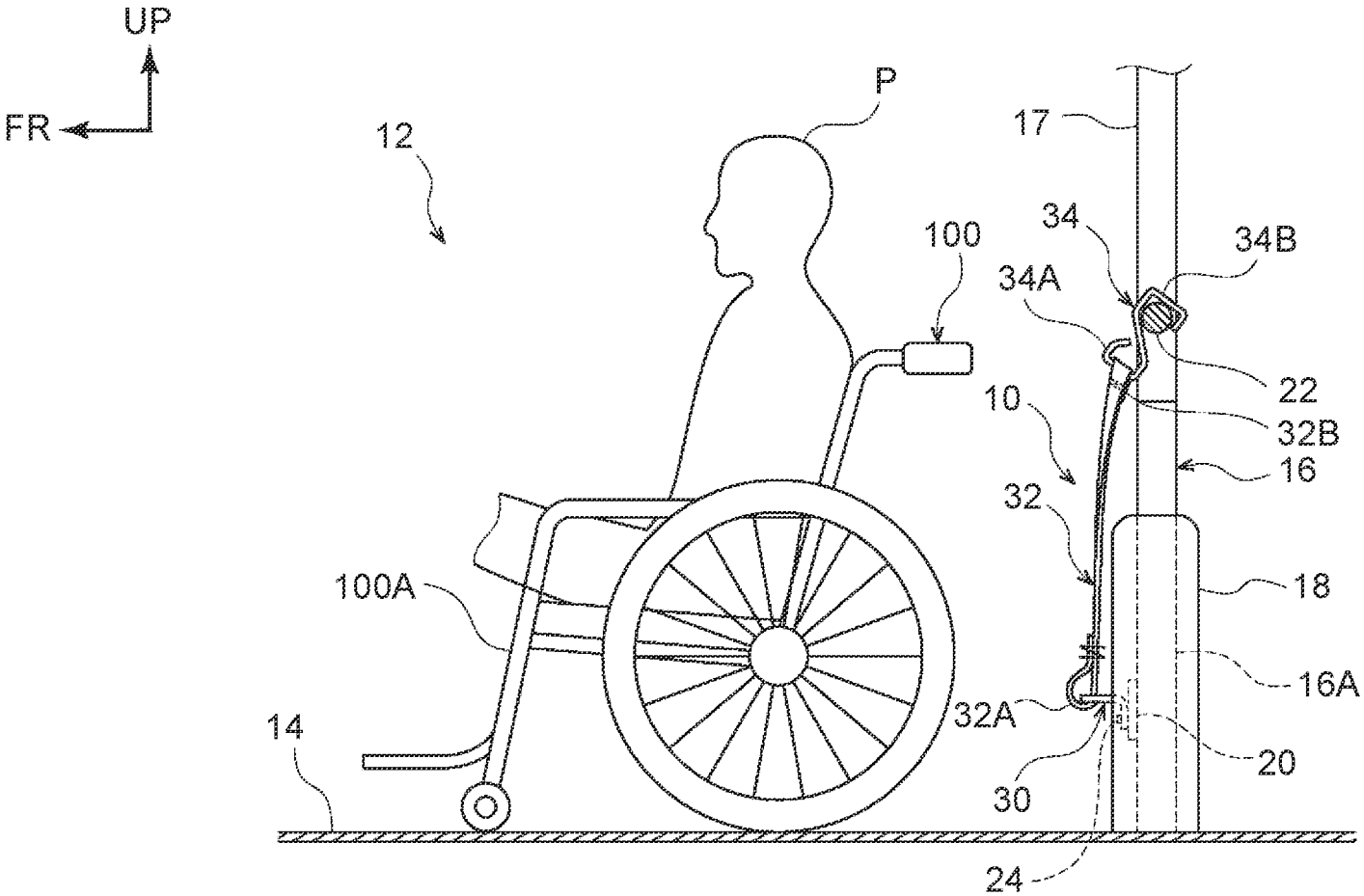
FIG. 2 is a side view of the vehicle cabin of the vehicle to which the wheelchair fixing tool according to the first embodiment is applied, as viewed from the vehicle width direction, showing a state before and after the wheelchair fixing tool is used.

The other end 34B of the hook 34 is formed in a hook shape, and is configured to be detachable from the wheelchair 100. FIG. 1 shows a state in which the other end 34B of the hook 34 is hooked on a frame 100A of the wheelchair 100. As shown in FIG. 2, in a state before and after the wheelchair fixing tool 10 is used, the other end 34B of the hook 34 is held while being hooked on the hook holder 22.

Here, the height of the hook holder 22 is set to a height reachable from an occupant P sitting in the wheelchair 100. In the present embodiment, as an example, the hook holder 22 is set at a shoulder height of the occupant P who has a standard adult size and sits in the wheelchair 100. In a state in which the hook 34 is hooked on the hook holder 22, the belt member 32 is in a pulled state. That is, the hook holder 22 is provided at a position where tension acts on the belt member 32 in a state in which the hook 34 is being hooked.

The wheelchair fixing device according to the present embodiment is configured as described above. When using the wheelchair fixing tool 10 from the state shown in FIG. 2, first, the occupant P sitting in the wheelchair 100 detaches the hook 34 from the hook holder 22. At this time, since the belt member 32 is formed of a flat rubber string, the occupant P can detach the hook 34 from the hook holder 22 simply by gripping and pulling up the hook 34.

Next, the occupant P carries out mounting of the wheelchair fixing tool 10 on one side by hooking the other end 34B of the detached hook 34 on the left side of the frame 100A of the wheelchair 100. At this time, the hook 34 is mounted to the wheelchair 100 while tension is applied to the belt member 32. Similarly, the occupant P carries out mounting of the wheelchair fixing tool 10 on the other side by detaching the hook (not shown) of this wheelchair fixing tool and hooking this hook on the right side of the frame 100A of the wheelchair 100. In this manner, the wheelchair 100 to which the pair of wheelchair fixing tools 10 are mounted is secured while tension is acting on the upright wall 16.

Next, operation of the present embodiment will be described.

In the wheelchair fixing device provided with the wheelchair fixing tools 10 according to the present embodiment, as shown in FIG. 3A and FIG. 3B, each wheelchair fixing tool 10 is configured by connecting the hook 34 and the plate 30 by the belt member 32 formed in a long shape. With this configuration, as shown in FIG. 1, the occupant P seated in the wheelchair 100 can secure the wheelchair 100 by mounting the hooks 34 to the wheelchair 100. That is, the wheelchair can be secured with a simple structure.

In the wheelchair fixing tool 10 of the present embodiment, the belt member 32 has stretchability. Therefore, the occupant P seated in the wheelchair 100 can detach the hook 34 from the wheelchair 100 by pulling the hook 34 against the tension of the belt member 32 from a state in which the hook 34 is mounted to the wheelchair 100, to thereby release the securing state of the wheelchair 100. As a result, for example, even in an emergency, the securing state of the wheelchair 100 can be easily released by the hands of the occupant P sitting in the wheelchair 100.

Further, since each belt member 32 has stretchability, when the vehicle 12 is braked by braking operation, the securing state of the wheelchair 100 can be maintained by the tension of the belt members 32. That is, in the vehicle 12 traveling at a low speed, the wheelchair 100 can be secured without using a device such as a retractor.

Furthermore, in the present embodiment, since each belt member 32 is formed of a flat rubber string, the belt member 32 can be provided with stretchability in an inexpensive and simple structure. In particular, in the present embodiment, since the entire belt member 32 is formed of a flat rubber string (elastic cord), the number of components can be reduced as compared with a case in which a part of the belt member 32 is formed of a rubber string.

In the present embodiment, as shown in FIG. 2, the hook 34 can be hooked on the hook holder 22 while the wheelchair 100 is out of use and is not secured. This configuration makes it easier for the occupant P seated in the wheelchair 100 to take the hook 34, as compared with the case in which the hook 34 is placed on the floor panel 14 in the vehicle cabin; therefore, the occupant can easily carry out the securing work.

Particularly, in the present embodiment, the hook 34 is hooked on the hook holder 22 while tension is applied to the belt member 32. Accordingly, it is possible to prevent the hook 34 from coming off from the hook holder 22 due to vibration of the vehicle 12 during traveling, or the like. That is, it is possible to maintain the state in which the hook 34 is hooked on the hook holder 22.

In the present embodiment, as shown in FIG. 3A and FIG. 3B, each wheelchair fixing tool 10 in which the hook 34 and the plate 30 are connected by only the belt member 32 has been described, but an applicable embodiment of the present disclosure is not limited to this. For example, a wheelchair fixing tool 40 as a modification shown in FIG. 4A and FIG. 4B may be employed.

Figure 4A:
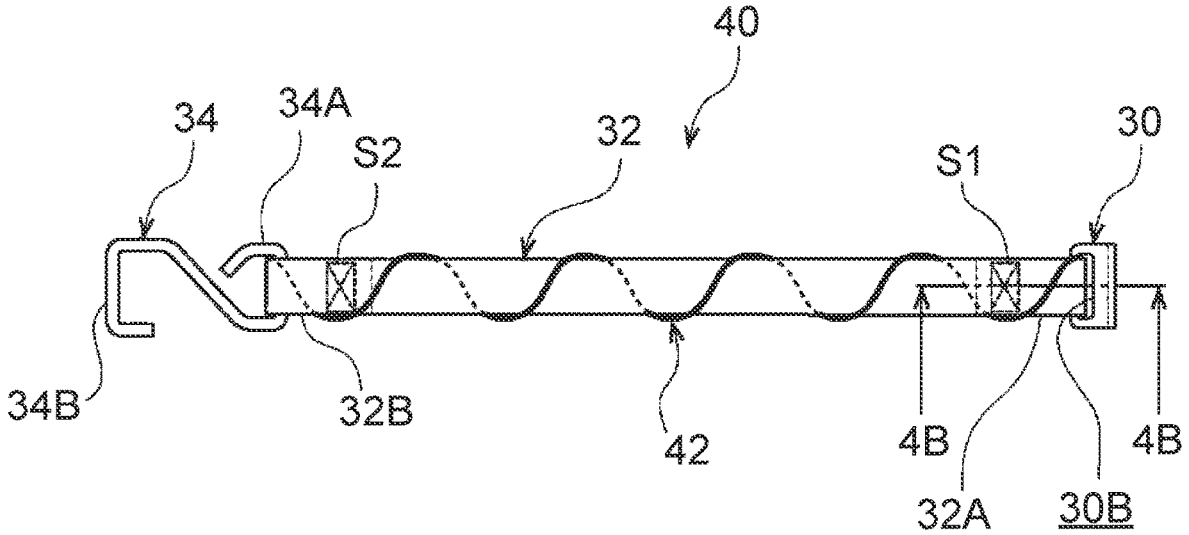
FIG. 4A is an overall view showing a modification of the wheelchair fixing tool according to the first embodiment.

As shown in FIG. 4A, the wheelchair fixing tool 40 according to the present modification is configured to include a metallic piano wire 42 (wire member) as a stretch restricting member. The piano wire 42 covered with resin extends along the belt member 32. Specifically, the piano wire 42 is wound in a substantially spiral manner around an outer circumferential surface of the belt member 32, and connects the hook 34 and the plate 30.

Figure 4B:
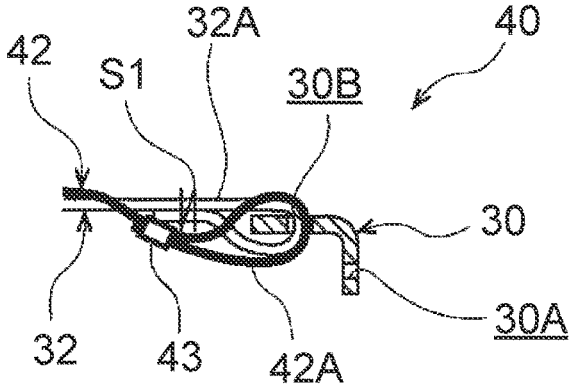
FIG. 4B is a view showing the modification of the wheelchair fixing tool according to the first embodiment, and is an enlarged view showing a state taken along line 4B-4B in FIG. 4A.

As shown in FIG. 4B, one end of the piano wire 42 is inserted together with the belt member 32 through the belt insertion hole 30B of the plate 30, and the piano wire 42 is folded back to be joined together by a joining member 43. This configuration prevents the piano wire 42 from coming off from the plate 30. Similarly, the other end of the piano wire 42 is fixed to the one end 34A of the hook 34 so as not to come off from the hook 34.

Here, a length of the piano wire 42 slacken is longer than the belt member 32 when the hook 34 is mounted to the wheelchair 100 as shown in FIG. 1. This configuration restrains the piano wire 42 from being tensed when the hook 34 is mounted to the wheelchair 100. In addition, the length of the piano wire 42 slacken is shorter than a length of the belt member 32 when the belt member becomes broken and disconnected. In this manner, by providing the piano wire 42, the belt member 32 is restrained from being stretched to a predetermined length or longer.

As described above, in the present modification, when the hook 34 is mounted to the wheelchair 100, the piano wire 42 causes no hindrance, and the piano wire 42 can be restrained from causing breakage of the belt member 32. That is, even when an excessive inertial force acts on the wheelchair 100 during a high-speed traveling of the vehicle 12, it is possible to maintain the securing state of the wheelchair 100. This operation will be described with reference to the graph of FIG. 5.

Figure 5:
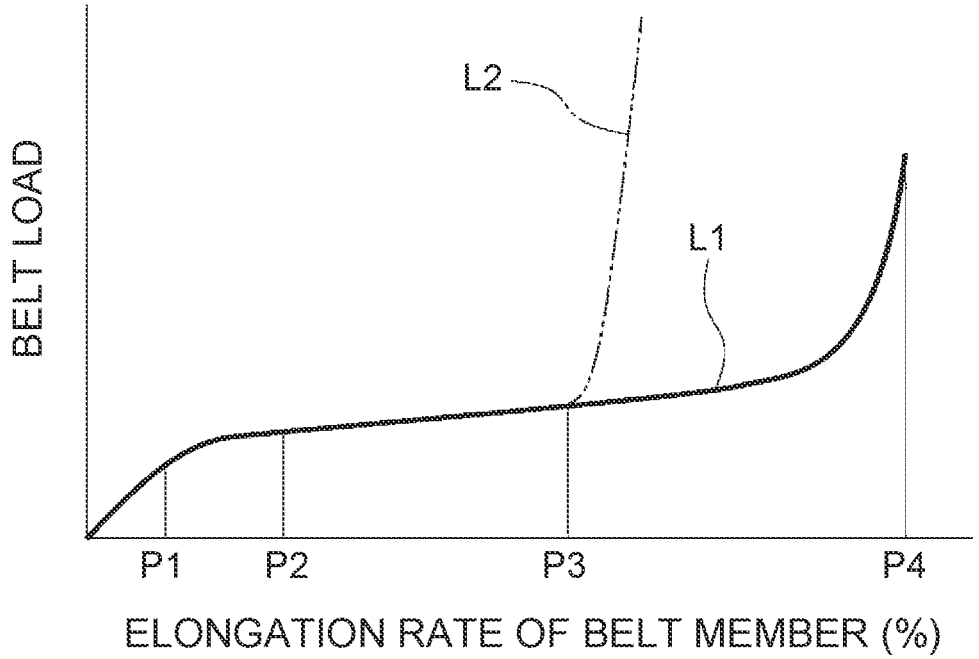
FIG. 5 is a graph showing a relationship between an elongation rate and a belt load of a belt member in the first embodiment.

In the graph shown in FIG. 5, a relationship between an elongation rate and a belt load of the belt member 32 is indicated by a solid line L1. A relationship between an elongation rate and a belt load of the belt member 32 in the case having the piano wire 42 is indicated by an imaginary line L2. Further, P1 is an elongation rate of the belt member 32 in a state in which the wheelchair fixing tool 40 is hooked on the hook holder 22 (see FIG. 2), and P2 is an elongation rate of the belt member 32 in a state in which the wheelchair 100 is secured. P3 is an elongation rate of the belt member 32 in a state in which the piano wire 42 is tensed, and P4 is an elongation rate thereof at the time of breakage and disconnection of the belt member 32.

Here, when a heavy load is input into the vehicle in the securing state of the wheelchair 100, the belt member 32 is tensed. Then, the belt member 32 is stretched from P2 further to P4. On the other hand, in the structure having the piano wire 42 as in the present modification, the piano wire 42 is tensed in a state in which the elongation rate of the belt member 32 is at P3, a curve indicated by the imaginary line L2 is obtained. That is, even when the belt load is increased, the piano wire 42 can bear the belt load, thereby restraining the belt member 32 from being stretched to be broken and disconnected.

In the present modification, the piano wire 42 is covered with resin. Therefore, enhancement of the design property can be promoted, and the belt member 32 can be prevented from being cut off by the piano wire 42. That is, the belt member 32 can be protected from the piano wire 42.

Next, a wheelchair fixing tool 50 according to the second embodiment will be described. Note that the same components as those in the first embodiment will be denoted by the same reference numerals, and description thereof will be appropriately omitted.

Figure 6:
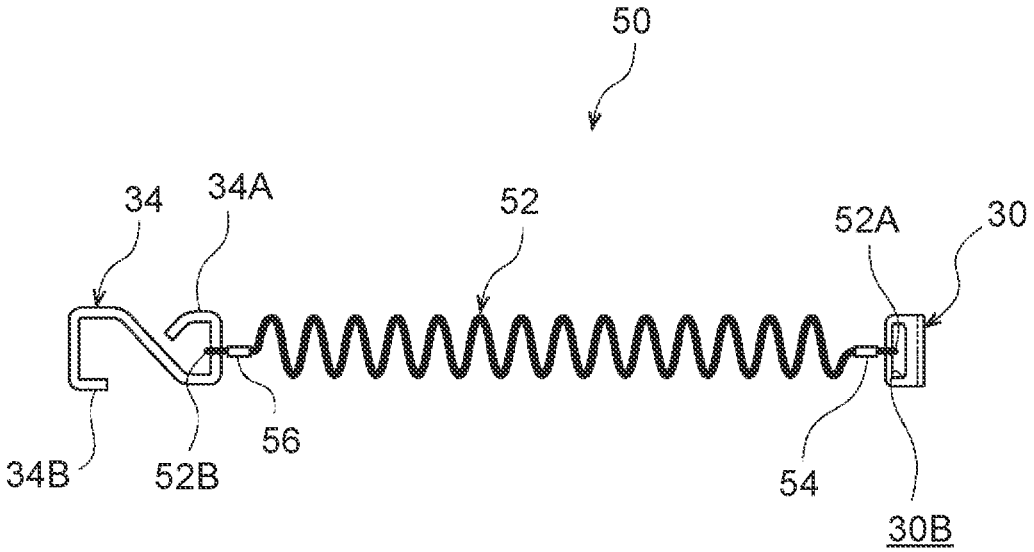
FIG. 6 is an overall view of a wheelchair fixing tool according to a second embodiment.

As shown in FIG. 6, the wheelchair fixing tool 50 of the present embodiment includes a belt member 52 instead of the belt member 32. At least a part of the belt member 52 is formed by a tension spring; and in the present embodiment, the entire belt member 52 is formed by a tension spring.

Specifically, one end 52A of the belt member 52 is inserted through the belt insertion hole 30B of the plate 30, and is folded back to be joined together by a joining member 54. This configuration prevents the one end 52A of the belt member 52 from coming off from the plate 30.

On the other hand, the other end 52B of the belt member 52 is inserted through the one end 34A of the hook 34, and is folded back to be joined together by a joining member 56. This configuration prevents the other end 52B of the belt member 52 from coming off from the hook 34. In addition, the belt member 52 is covered from the outside with a stretchable cloth material (not shown).

Next, operation of the present embodiment will be described.

In the wheelchair fixing tool 50 according to the present embodiment, the belt member 52 is formed by a tension spring. Accordingly, the occupant P seated in the wheelchair 100 can detach the hook 34 from the wheelchair 100 by pulling the hook 34 against the tension of the belt member 52, to thereby release the securing state of the wheelchair 100. As a result, for example, even in an emergency, the wheelchair 100 can be easily released from the securing state by the hands of the occupant P sitting in the wheelchair 100 (see FIG. 1).

In the present embodiment, even when the belt load is increased in the case in which the belt member 52 is fully stretched at the time of sudden braking, it is possible to restrict the belt member 52 from being stretched to a predetermined length or longer. That is, the belt member 52 can be restricted from being stretched to the predetermined length or longer without separately providing a stretch restricting member such as a piano wire. As a result, it is possible to restrict the belt member 52 from being stretched to the predetermined length or longer with a simple structure.

Furthermore, in the present embodiment, the design property can be enhanced by covering the belt member 52 from the outside with a stretchable cloth material; and moreover, it is possible to prevent a finger from being caught by the tension spring of the belt member 52.

Next, a wheelchair fixing tool 60 according to the third embodiment will be described. Note that the same components as those in the first embodiment will be denoted by the same reference numerals, and description thereof will be appropriately omitted.

Figure 7A:
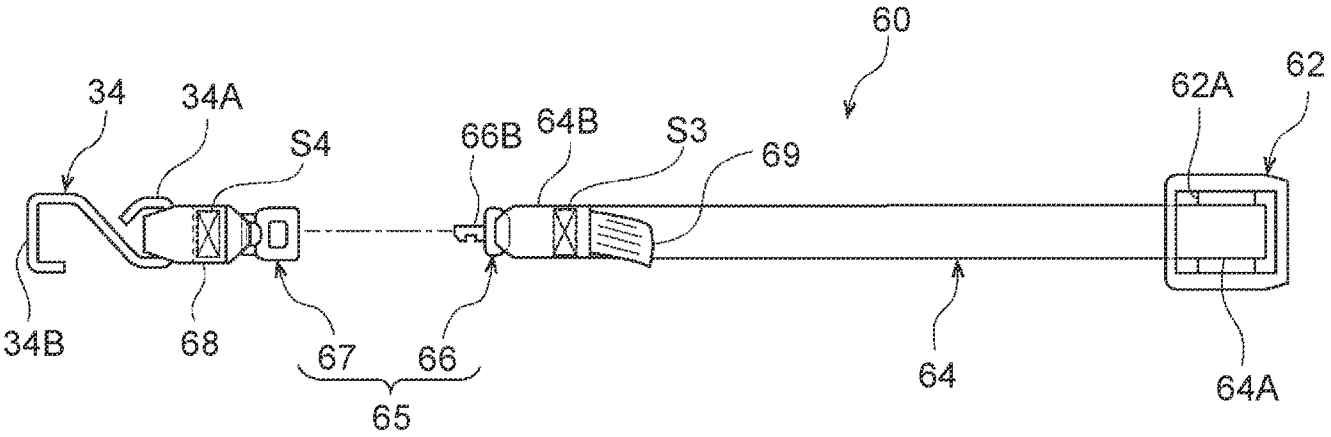
FIG. 7A is an overall view of a wheelchair fixing tool according to a third embodiment.

As shown in FIG. 7A, the wheelchair fixing tool 60 of the present embodiment mainly includes a retractor 62, a belt member 64, the hook 34, and a connecting member 65. In the present embodiment, the wheelchair 100 is secured using a pair of wheelchair fixing tools 60.

The retractor 62 is formed with a bolt insertion hole (not shown). Then, a bolt is inserted through the bolt insertion hole and is screwed into the mounting bracket 20, to thereby fasten the retractor 62 to the mounting bracket 20 (see FIG. 1). That is, the retractor 62 is fixed to the upright wall 16 via the mounting bracket 20.

The retractor 62 includes a rotatable spool 62A, around which one end 64A of the belt member 64 is wound. The belt member 64 is formed to be long, and in the present embodiment, as an example, the belt member 64 is formed of the same cloth material as that of a seat belt. Furthermore, the retractor 62 includes an automatic locking mechanism (ALR: automatic locking retractor) for restricting the belt member 64 from being pulled out in accordance with the amount of wind-up of the belt member 64, and also includes an emergency locking mechanism (ELR: emergency locking retractor) for restricting the belt member 64 from being pulled out in an emergency, such as a vehicle collision.

A connecting member 65 is provided to the other end 64B of the belt member 64, and the connecting member 65 is configured to include a connecting tongue 66 and a connecting buckle 67.

Figure 7B:
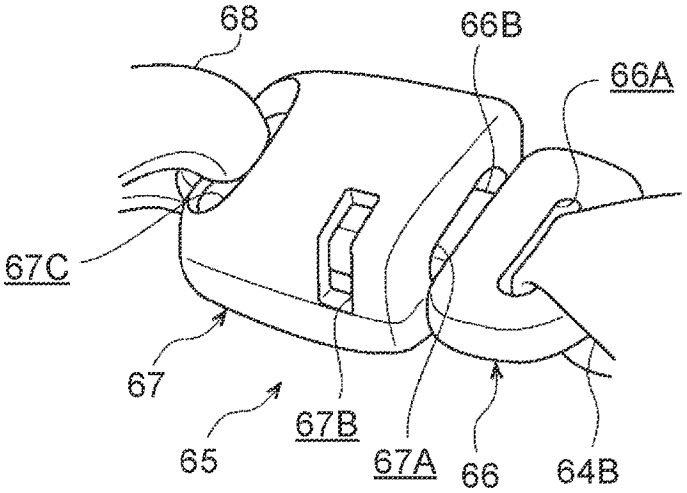
FIG. 7B is a view showing the wheelchair fixing tool according to the third embodiment, and is an enlarged perspective view showing a major part of FIG. 7A in an enlarged manner.

As shown in FIG. 7B, the connecting tongue 66 is formed with a belt insertion hole 66A. The other end 64B of the belt member 64 is inserted through the belt insertion hole 66A, and is folded back and stitched at a stitched portion S3. Therefore, the connecting tongue 66 is configured not to come off from the belt member 64. The front end of the connecting tongue 66 has a substantially L-shaped engaging portion 66B.

On the other hand, the connecting buckle 67 is a hollow member, and one end of the connecting buckle 67 is formed with an insertion hole 67A into which the engaging portion 66B of the connecting tongue 66 is inserted. A peripheral wall of the connecting buckle 67 is formed with an unlock hole 67B, and the engaging portion 66B of the connecting tongue 66 is exposed through the unlock hole 67B. Furthermore, a return spring (not shown) is provided inside the connecting buckle 67 so as to urge the connecting tongue 66 in a direction of pushing out the connecting tongue 66. The unlock hole 67B is formed in a slit shape and in a size that prevents the occupant's finger from entering this hole.

The other end of the connecting buckle 67 is formed with a belt insertion hole 67C, and a connecting belt 68 is inserted through the belt insertion hole 67C. As shown in FIG. 7A, the connecting belt 68 is formed in a ring shape and connects the connecting buckle 67 and the one end 34A of the hook 34. That is, in a state in which the connecting tongue 66 is engaged with the connecting buckle 67, the belt member 64 and the hook 34 are connected by the connecting member 65 via the connecting belt 68.

Here, in the present embodiment, in a state in which the connecting tongue 66 is engaged with the connecting buckle 67, this engagement state can be released by handling of the occupant P sitting in the wheelchair 100. Specifically, by inserting a card or the like into the unlock hole 67B formed in the connecting buckle 67, the engaging portion 66B of the connecting tongue 66 is pressed to release the engagement state. That is, the connection state between the belt member 64 and the hook 34 can be released by the handling of the occupant P sitting in the wheelchair 100. Note that a dedicated key to be inserted into the unlock hole 67B may be used.

In the present embodiment, a tag 69 formed in a conspicuous color is stitched to the other end 64B of the belt member 64. On this tag 69, there is a description about a procedure for releasing the engagement state between the connecting tongue 66 and the connecting buckle 67.

Next, operation of the present embodiment will be described.

In the wheelchair fixing tool 60 according to the present embodiment, when the wheelchair 100 is secured by the occupant P seated in the wheelchair 100 (see FIG. 1), the belt member 64 is pulled out from the retractor 62 by pulling the hook 34. Then, the hook 34 can be mounted to the wheelchair 100 and the locking mechanism of the retractor 62 can be operated to lock the pull-out of the belt member 64, to thereby readily secure the wheelchair 100. At this time, slack of the belt member 64 may be removed by rotating the spool 62A with a motor or the like.

In addition, in the present embodiment, the engagement state between the connecting tongue 66 and the connecting buckle 67 is released by inserting a card or the like into the unlock hole 67B, and the connecting tongue 66 is then pushed out by the return spring (not shown). Thus, the hook 34 can be detached from the belt member 64, and the connection state between the belt member 64 and the hook 34 can be released by the handling of the occupant P. Thus, the occupant P sitting in the wheelchair 100 can release the securing state of the wheelchair 100 simply by handling the connecting member 65. Accordingly, as in the first embodiment, the securing state of the wheelchair 100 can be easily released by the hands of the occupant P sitting in the wheelchair 100 even in an emergency.

Particularly, in the present embodiment, the connection state between the belt member 64 and the hook 34 can be released separately in the pair of wheelchair fixing tools 60. Accordingly, the securing state of the wheelchair 100 can be released more easily as compared with the configuration of engaging one belt with the other belt so as to secure the wheelchair.

In addition, in the present embodiment, the unlock hole 67B of the connecting buckle 67 is formed in a size that prevents the occupant's finger from entering this hole. Thereby, it is possible to prevent the engagement state between the connecting tongue 66 and the connecting buckle 67 from being carelessly released.

Moreover, in the present embodiment, since the tag 69 is provided to the other end 64B of the belt member 64, the occupant P can easily understand how to release the securing state of the wheelchair 100.

In the present embodiment, the structure including the connecting member 65 configured to include the connecting tongue 66 and the connecting buckle 67 has been described, but an applicable embodiment of the present disclosure is not limited to this. For example, a structure shown in FIG. 8 may be adopted.

Figure 8:
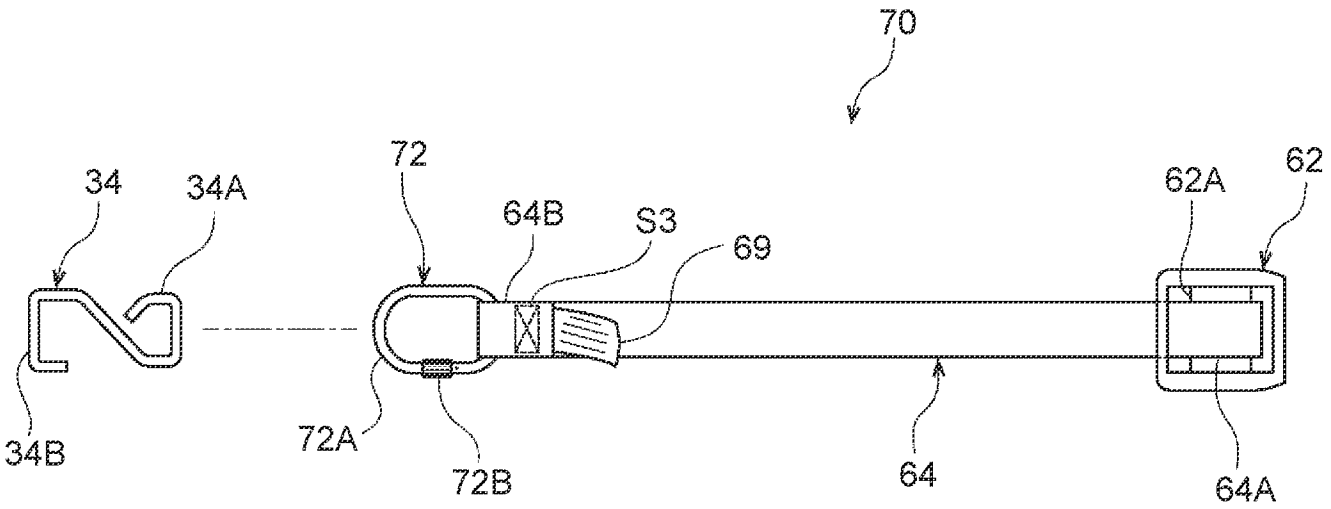
FIG. 8 is an overall view showing a modification of the wheelchair fixing tool according to the third embodiment, the view corresponding to FIG. 7A.

As shown in FIG. 8, in the wheelchair fixing tool 70 of the present modification, a carabiner 72 as a connecting member is provided instead of the connecting member 65 of FIG. 7A and FIG. 7B. Specifically, the carabiner 72 is attached to the other end 64B of the belt member 64.

The carabiner 72 includes a substantially annular main body 72A, and this annular main body 72A is formed in a substantially C shape that partially opens. Further, a lever member 72B is attached to the main body 72A such that the opening of the main body 72A is closed in an openable manner by the lever member 72B. In addition, a return spring (not shown) is provided inside the lever member 72B, and the return spring urges the lever member 72B in the closing direction of the main body 72A.

In the present modification, the occupant P (see FIG. 1) seated in the wheelchair 100 handles the lever member 72B against the urging force of the return spring so as to release the connection state between the belt member 64 and the hook 34.

The wheelchair fixing tools according to the embodiments and the modification have been described above. However, it is needless to mention that the wheelchair fixing tools can be implemented in various modes without departing from the gist of the present disclosure. For example, in the first embodiment, the entire belt member 32 is formed of a flat rubber string as the belt member 32, but an applicable embodiment of the present disclosure is not limited to this. That is, a part of the belt member may be formed of a rubber string, and the other part thereof may be formed of a non-stretchable member other than the rubber string. Similarly, in the second embodiment, the entire belt member 52 is formed by a tension spring, but an applicable embodiment of the present disclosure is not limited to this, and a part of the belt member 52 may be formed by a tension spring, and the other part thereof may be formed by a member other than a tension spring, such as a member like webbing having no stretchability.

Further, in the above-described embodiment, it is configured that the wheelchair 100 is secured by the pair of wheelchair fixing tools, but an applicable embodiment of the present disclosure is not limited to this. For example, there may be employed a configuration in which the wheelchair 100 is secured by one wheelchair fixing tool. In this case, the hook of the wheelchair fixing tool may be attached to the center of the frame of the wheelchair 100. Conversely, the wheelchair 100 may be secured by three or more wheelchair fixing tools.

Furthermore, in each of the wheelchair fixing tools of the above embodiments, as shown in FIG. 1 and FIG. 2, the plate 30 as the fixing part is fixed to the upright wall 16, but an applicable embodiment of the present disclosure is not limited to this. For example, in place of the plate 30, there may be employed such a structure that has a detachable part that can be fixed to the upright wall 16 or the handrail 17. In this case, before being in use, the wheelchair fixing tool can be accommodated in a place where the occupant P sitting in the wheelchair 100 can reach. In use, the occupant seated in the wheelchair can secure the wheelchair 100 by fixing the detachable part of the wheelchair fixing tool to the upright wall 16 or the handrail 17, and then attaching the hook 34 to the frame 100A of the wheelchair 100, thereby securing the wheelchair 100. That is, the wheelchair 100 can be secured to any other places in the vehicle cabin as far as the detachable part can be fixed. Note that a hook having the same shape as that of the hook 34 can be used as the detachable part. In this case, the wheelchair fixing tool has such a structure that connects the hooks at both ends of the wheelchair fixing tool to each other by the belt member 32. As the detachable part, clip-shaped members or the like can be used, other than the hooks.

Furthermore, in the third embodiment, the structure in which the retractor 62 having the functions of the ALR and the ELR is applied has been described; and in addition to this, there may be adopted such a structure that separately provides a lock mechanism. For example, there may be adopted such a structure that provides a lock mechanism capable of performing locking and unlocking of pull-out of the belt member 64 at any timing. This lock mechanism may be operated as the occupant handles a switch (not shown) or the like.

In the above-described embodiment, the hook 34 is held while being hooked on the hook holder 22, but an applicable embodiment of the present disclosure is not limited to this configuration. For example, a structure that has no hook holder 22 may be adopted. In this case, when the wheelchair fixing tool 10 is out of use, the belt member may be wound around the handrail 17 so as not to interfere with the occupant. Moreover, the hook holder 22 is provided at a position where tension acts on the belt member 32, but an applicable embodiment of the present disclosure is not limited to this. For example, in the case in which the hook holder 22 is provided below the position in FIG. 1, the hook 34 may be hooked on the hook holder 22 with the belt member 32 wound around the handrail 17, to thereby prevent the hook 34 from coming off from the hook holder 22 due to vibration of the vehicle 12 during traveling.

What is claimed is:

1. A wheelchair fixing tool comprising:

a fixing part fixed to an upright member uprightly provided in a vehicle cabin;

a hook detachable from a wheelchair; and a belt member formed long, having stretchability, and connecting the fixing part and the hook, at least a part of the belt member is formed by a rubber string.

2. The wheelchair fixing tool according to claim 1, wherein the belt member is provided with a stretch restricting member restricting the belt member from being stretched to a predetermined length or longer.

3. The wheelchair fixing tool according to claim 2, wherein:

the stretch restricting member is a metallic wire member extending along the belt member and connecting the fixing part and the hook; and the wire member is formed to be longer than the belt member in a state in which the hook is mounted to the wheelchair and be shorter than a length at which the belt member becomes broken and disconnected.

4. A wheelchair fixing tool comprising:

a belt member formed long;

a retractor fixed to an upright member uprightly provided in a vehicle cabin, one end of the belt member being wound around the retractor, the retractor restricting pull-out of the belt member according to an amount of wind-up of the belt member;

a hook detachable from the wheelchair; and a connecting member that is provided to the other end of the belt member, connects the belt member and the hook, and is able to release connection between the belt member and the hook by handling of an occupant seated in the wheelchair, wherein the connecting member includes a first connection member and a second connection member opposite the first connection member, the first connection member is provided on an end of the hook, and the second connection member is provided on an end of the belt member opposite the hook, wherein the connection between the first connection member and second connection member connects the belt member and the hook.

5. A wheelchair fixing device including:

a fixing part fixed to an upright member uprightly provided in a vehicle cabin;

a hook detachable from a wheelchair;

a belt member formed long, having stretchability, and connecting the fixing part and the hook; and a hooking part provided to the upright member and configured to be able to hold the hook in a state of being hooked on the hooking part.

6. The wheelchair fixing device according to claim 5, wherein the hooking part is provided at a position where tension acts on the belt member in a state in which the hook is hooked.

7. The wheelchair fixing device according to claim 5, wherein the belt member is provided with a stretch restricting member restricting the belt member from being stretched to a predetermined length or longer.

8. The wheelchair fixing device according to claim 7, wherein:

the stretch restricting member is a metallic wire member extending along the belt member and connecting the fixing part and the hook; and the wire member is formed to be longer than the belt member in a state in which the hook is mounted to the wheelchair and to be shorter than a length at which the belt member becomes broken and disconnected.

9. The wheelchair fixing device according to claim 5, wherein at least a part of the belt member is formed by a tension spring.

10. The wheelchair fixing tool according to claim 1, wherein the rubber string is an elastic cord.

* * * * *